US008330698B2

(12) United States Patent
Son et al.

(10) Patent No.: US 8,330,698 B2
(45) Date of Patent: Dec. 11, 2012

(54) LCD OUTPUT ENABLE SIGNAL GENERATING CIRCUITS AND LCDS COMPRISING THE SAME

(75) Inventors: Sun-kyu Son, Suwon-si (KR); Myong-bin Lim, Seoul (KR); In-yong Hwang, Suwon-si (KR); Jae-han Lee, Chungcheongnam-do (KR); Ock-jin Kim, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 1224 days.

(21) Appl. No.: 11/880,916

(22) Filed: Jul. 24, 2007

(65) Prior Publication Data

US 2008/0030490 A1 Feb. 7, 2008

(30) Foreign Application Priority Data

Jul. 25, 2006 (KR) ..... 10-2006-0069874

(51) Int. Cl.
*G09G 3/36* (2006.01)

(52) U.S. Cl. ..... 345/99; 345/209

(58) Field of Classification Search ..... 345/94, 345/98–100, 208, 209
See application file for complete search history.

(56) References Cited

U.S. PATENT DOCUMENTS

| | | | | |
|---|---|---|---|---|
| 6,407,729 | B1 * | 6/2002 | Moon | 345/99 |
| 2004/0095308 | A1 * | 5/2004 | Kim et al. | 345/99 |
| 2004/0174330 | A1 * | 9/2004 | Huang et al. | 345/100 |
| 2005/0057480 | A1 * | 3/2005 | Liao et al. | 345/98 |
| 2007/0029585 | A1 * | 2/2007 | Lee | 257/270 |

FOREIGN PATENT DOCUMENTS

JP 2005-078065 3/2005

* cited by examiner

*Primary Examiner* — Chanh Nguyen
*Assistant Examiner* — Allison Walthall
(74) *Attorney, Agent, or Firm* — Innovation Counsel LLP

(57) ABSTRACT

A signal generating circuit for a liquid crystal display (LCD) includes circuitry adapted to receive a gate clock signal and an output enable signal. The gate clock signal is a combination of a gate-on signal and a gate-off signal and the output enable signal is operable to adjust the width of the gate-on signal. The signal generating circuit adjusts the output enable signal such that a falling edge of the output enable signal overlaps a rising edge of the gate clock signal and thereby delays the gate clock signal for a selected amount of time.

16 Claims, 7 Drawing Sheets

LCD OUTPUT ENABLE SIGNAL GENERATING CIRCUITS AND LCDS COMPRISING THE SAME

RELATED APPLICATIONS

This application claims priority of Korean Patent Application No. 10-2006-0069874, filed Jul. 25, 2006, the entire disclosure of which is incorporated herein by reference.

BACKGROUND

The present disclosure relates to signal generating circuits for liquid crystal displays (LCDs) and LCDs comprising the same, and more particularly, to LCD signal generating circuits that prevent the malfunction of LCD gate drivers and LCDs comprising the same.

LCDs generally include an LCD panel comprising a thin film transistor (TFT) substrate having a plurality of TFTs, each operable to switch one of a plurality of pixels thereof, a color filter substrate having a plurality of color pixels, and a layer of a liquid crystal material hermetically sealed between the two substrates. When an electric field is applied to the liquid crystal layer associated with one of the pixels, the molecules of the layer change their orientations, causing the transmissive index of light of the layer to change in accordance with the orientations of the liquid crystal molecules.

LCDs typically include a driving circuit comprising a timing controller, a driving voltage generator, a gate driver, and a data driver. The data driver outputs a selected voltage that swings with reference to a common voltage to impart a potential difference to the liquid crystal material. When an overly large positive (+) polarity voltage is output from the data driver relative to the common voltage, or when an overly large negative (−) polarity voltage is output from the data driver relative thereto, a coupling phenomenon occurs, such that not only ambient signals but also gate lines may be adversely affected thereby. The coupling phenomenon may be even more severe in an LCD that lacks a gate driver PCB, resulting in a malfunction of the gate driver. Specifically, noise generated by the coupling adversely affects a gate clock signal (CPV), thereby preventing the gate driver from properly detecting the gate clock signal (CPV).

BRIEF SUMMARY

In accordance with the exemplary embodiments thereof described herein, signal generating circuits for LCDs are disclosed that prevent malfunctioning of the gate drivers of the LCDs due to the coupling phenomenon described above.

In one exemplary embodiment, a signal generating circuit receives a gate clock signal, which is a combination of a gate-on signal and a gate-off signal, and an output enable signal that adjusts the width of the gate-on signal. The signal generating circuit adjusts the output enable signal OE such that the falling edge of the output enable signal OE overlaps the rising edge of the gate clock delay signal that delays the gate clock signal for a selected amount of time.

In another exemplary embodiment, an LCD includes a liquid crystal display panel having a plurality of unit pixels respectively defined at interconnections of a plurality of gate lines and data lines and arranged in substantially a matrix form, a timing controller generating a plurality of control signals for controlling the liquid crystal panel, the control signals including a gate clock signal, comprising a combination of a gate-on signal and a gate-off signal, and an output enable signal operable to adjust the width of the gate-on signal, a driving voltage generator receiving the plurality of control signals and generating a plurality of driving voltages, a gate driver, including a signal generating circuit receiving the plurality of driving voltages and applying the received driving voltages to the gate lines, and operable to adjust the output enable signal such that the falling edge of the output enable signal overlaps the rising edge of the gate clock delay signal, and a data driver applying data voltages to the data lines.

A better understanding of the above and many other features and advantages of the novel LCD signal generating circuits of the present invention may be obtained from a consideration of the detailed description of some exemplary embodiments thereof below, particularly if such consideration is made in conjunction with the appended drawings, wherein like reference numerals are used to identify like elements illustrated in one or more of the figures thereof.

DETAILED DESCRIPTION

Figure 1:
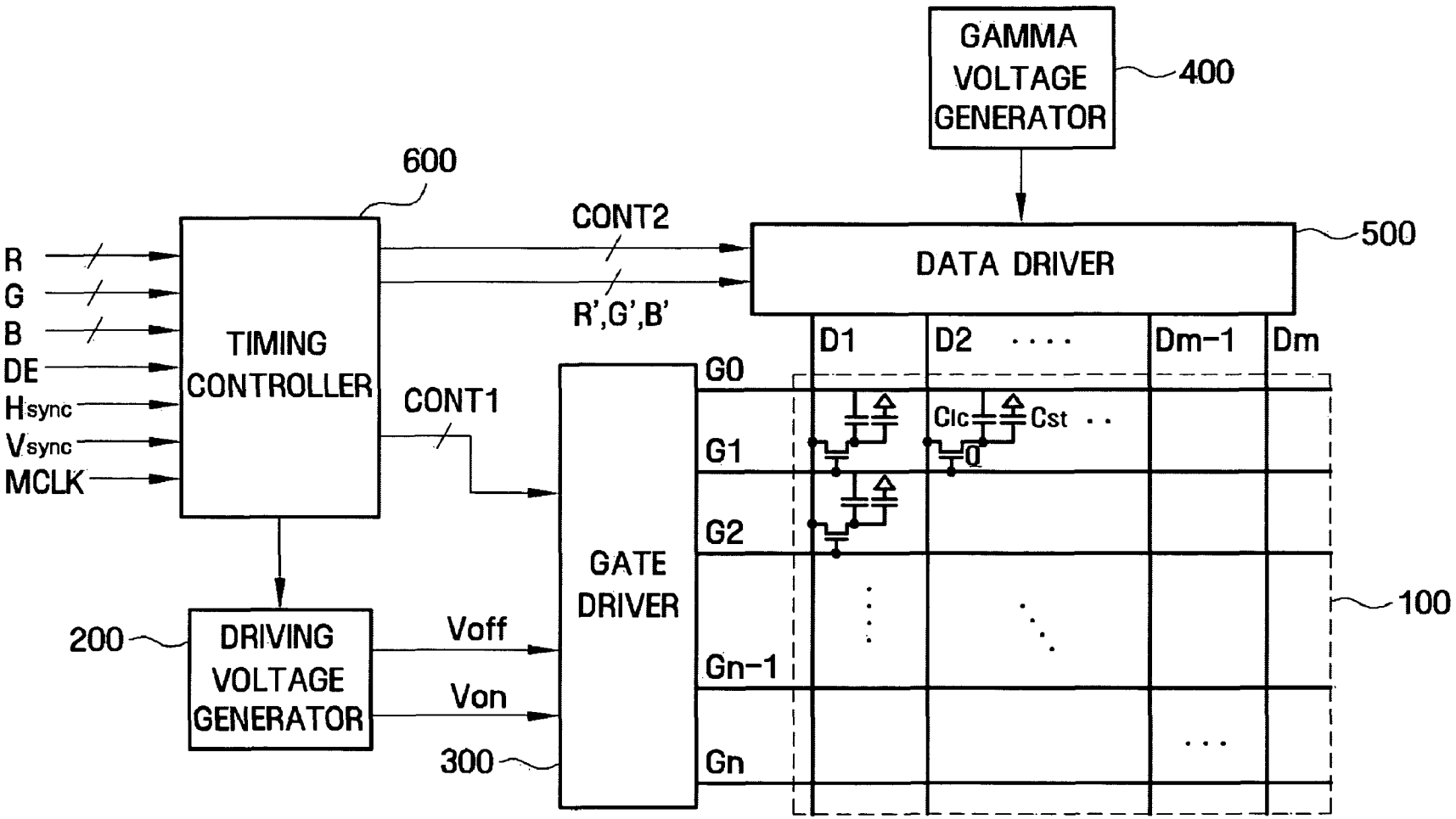
FIG. 1 is a partial circuit and functional block diagram of a first exemplary embodiment of an LCD in accordance with the present invention.

FIG. 1 is a partial circuit and functional block diagram of an exemplary embodiment of an LCD in accordance with the present invention. In FIG. 1, the LCD includes an LCD panel 100, a driving voltage generator 200, a gate driver 300, a gamma voltage generator 400, a data driver 500, and a timing controller 600.

As illustrated in FIG. 1, the liquid crystal display panel 100 includes a plurality of unit pixels connected to a plurality of display signal lines G1-Gn and D1-Dm and arranged substantially in the form of a matrix. The display signal lines G1-Gn and D1-Dm include a plurality of gate lines G1-Gn that transmit respective gate signals and a plurality of data lines D1-Dm that transmit respective data signals. The gate lines G1-Gn extend substantially in a row direction and are substantially parallel with each other, while the data lines D1-Dm extend substantially in a column direction and are substantially parallel with each other.

Each of the pixels comprises a switching element Q connected to associated ones of the plurality of display signal lines G1-Gn and D1-Dm, an associated liquid crystal capacitor Clc and an associated storage capacitor Cst connected to the switching element Q. In an alternative embodiment, the storage capacitors Cst may be omitted.

Each of the switching elements Q is disposed on a thin film transistor (TFT) substrate and has three terminals, a control terminal connected to the associated gate line G1-Gn, an input terminal connected to the associated data line D1-Dm, and an output terminal connected to both the associated liquid crystal capacitor Clc and the associated storage capacitor Cst.

Each liquid crystal capacitor Clc includes two terminals, comprising a pixel electrode disposed on the TFT substrate and a common electrode disposed on a color filter substrate. The liquid crystal layer disposed between the two electrodes functions as the dielectric of the liquid crystal capacitor Clc. The pixel electrode is connected to the switching element Q and the common electrode, which covers the entire surface of the color filter substrate, is connected to the common voltage Vcom. In an alternative embodiment, the common electrode may be disposed on the TFT substrate, and in either case, both electrodes have a bar or stripe shape.

Each storage capacitor Cst is defined by the overlap of the associated pixel electrode and a separate wire (not illustrated) disposed on the TFT substrate that has a selected voltage, such as the common voltage Vcom, applied to it (a "separate wire" type storage capacitor). Alternatively, the storage capacitor Cst may be defined by the overlap of the associated pixel electrode and an adjacent gate line through an insulator (a "previous gate" type storage capacitor).

For color displays, each pixel represents its own color by disposing one of a plurality of red, green and blue color filters in an area corresponding to the pixel electrode. In such an embodiment, the color filter is disposed in the corresponding area of the color filter substrate. Alternatively, the color filters may be disposed on or below the respective pixel electrodes of the TFT substrate.

One or more polarizers (not illustrated) attached to at least one of the TFT substrate and the color filter substrate of the liquid crystal display panel 100 function to convert the light polarization of the pixels into a light transmittance of the pixels.

The driving voltage generator 200 generates a plurality of driving voltages used in the operation of the LCD. For example, the driving voltage generator 200 generates a gate-on voltage Von, a gate-off voltage Voff, and a common voltage Vcom.

The gate driver 300 is connected to the gate lines G1-Gn of the liquid crystal panel 100 and receives gate signals from an external device and conveys them to the gate lines G1-Gn, each gate signal being a combination of a gate-on voltage Von and a gate-off voltage Voff.

In the particular exemplary embodiment illustrated in FIG. 1, the gate driver 300 may further comprise a signal generating circuit (not shown in FIG. 1) that receives a gate clock signal (CPV), which is the combination of a gate-on signal and a gate-off signal, and an output enable signal (OE) that is operable to adjust the width of the gate-on signal, the signal generating circuit being operable, when a falling edge of the output enable signal OE precedes a rising edge of a gate clock delay signal, to adjust the output enable signal OE such that the falling edge of the output enable signal OE overlaps the rising edge of the gate clock delay signal. This signal generating circuit is described in more detail below in connection with FIGS. 2-4.

The gamma voltage generator 400 generates two sets of gray voltages related to the transmittance of the pixels. The data voltages in one set have a positive polarity with respect to the common voltage Vcom, while those in the other set have a negative polarity with respect to the common voltage Vcom. The positive-polarity data voltages and negative-polarity data voltages are alternately supplied to the liquid crystal panel 100 during "inversion driving" of the display.

The data driver 500 is connected to the plurality of data lines D1-Dm of the LCD panel 100. The data driver 500 generates gray voltages based on a plurality of voltages supplied from the gamma voltage generator 400, selects the generated gamma voltages, and applies the gamma voltages to each pixel as data signals. The data driver 500 typically includes a plurality of integrated circuits (ICs).

The timing controller 600 generates control signals for controlling the gate driver 400, the data driver 500, and other LCD components, and supplies the control signals to the corresponding components.

The operation of the exemplary LCD is as follows. The timing controller 600 is supplied by an external graphic controller (not illustrated) with RGB image signals R, G and B and input control signals that control the display of the LCD, for example, a vertical synchronization signal Vsync, a horizontal synchronization signal Hsync, a main clock MCLK, a data enable signal DE, and the like. The timing controller 600 generates a plurality of gate control signals CONT1, a plurality of data control signals CONT2, and a common voltage control signal CONT3, and processes the image signals R, G and B for the LCD panel 100 on the basis of the input control signals. The timing controller 600 provides the gate control signals CONT1 for the gate driver 400, the data control signals CONT2 and the processed image signals R', G' and B' for the data driver 500.

The gate control signals CONT1 include a vertical synchronization start signal STV for indicating the start of a frame, a gate clock signal CPV for controlling the output time of the gate-on voltage Von, and an output enable signal OE for defining the width of the gate-on voltage Von. The output enable signal OE and the gate clock signal CPV are supplied to the driving voltage generator 200.

The data control signals CONT2 include a horizontal synchronization start signal STH for indicating the start of a horizontal period, a load signal LOAD for instructing the data driver 500 to apply the appropriate data voltages to the data lines D1-Dm, an inversion control signal RVS for reversing the polarity of the data voltages with respect to the common voltage Vcom (referred to as a data-voltage polarity), and a data clock signal HCLK.

The data driver 500 receives a packet of the image data R', G' and B' for a pixel row from the timing controller 600 in response to the data control signal CONT2 received from the timing controller 600 and converts the image data R', G' and B' into data voltages selected from the gray voltages.

Responsive to the gate control signals CONT1 from the timing controller 600, the gate driver 300 applies the gate-on voltage Von to the gate line G1-Gn, thereby turning on the switching elements Q connected thereto.

During the time in which the switching elements Q are turned on, which is called "one horizontal period" or "1H," and is equal to one period of the horizontal synchronization signal Hsync, the data enable signal DE, and the gate clock signal CPV, the data driver 500 applies the data voltages to the corresponding data lines D1-Dm, due to the application of the gate-on voltage Von to gate lines G1-Gn connected to the switching elements Q. The data voltages, in turn, are then supplied to the corresponding pixels via the turned-on switching elements Q.

The molecules of the liquid crystal material in each of the liquid crystal capacitors Clc have orientations that depend on the variation of the electric field generated by the pixel electrode and the common electrode, and the molecular orientations, in turn, determine the polarization of light passing through the liquid crystal layer. A change in polarization results in a change in the amount of transmittance of light passing through one or more polarizers (not illustrated) attached to at least one of the TFT and the color filter substrates.

In this manner, during one frame, the gate-on voltage Von is sequentially applied to all the gate lines G1 to Gn, so that the data voltages are applied to all of the pixels. When one frame ends, the next frame starts, and the state of the reverse signal RVS applied to the data driver 500 is controlled such that the polarity of the data signal applied to each of the pixels is opposite to the polarity in the previous frame (called "frame inversion"). In an alternative embodiment, instead of effecting frame inversion, the data driver 500 may invert the polarities of the data voltages applied to the adjacent data lines D1 to Dm in one frame, so that the polarities of the pixel voltages of the pixels applied with the data voltages also change, referred to as "line inversion." In yet another possible embodiment, line inversion can be made "column inversion," which is referred to as a "dot inversion" technique.

Figure 2:
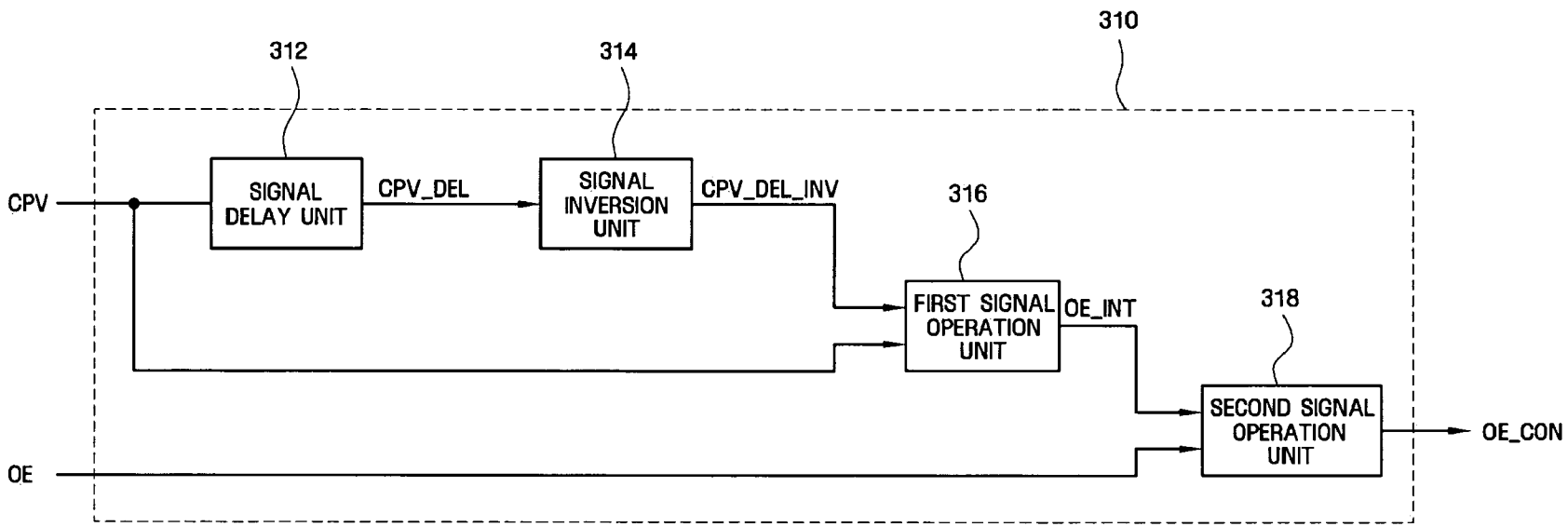
FIG. 2 is a functional block diagram of a first exemplary embodiment of a signal generating circuit of the exemplary LCD of FIG. 1.
Figure 3:
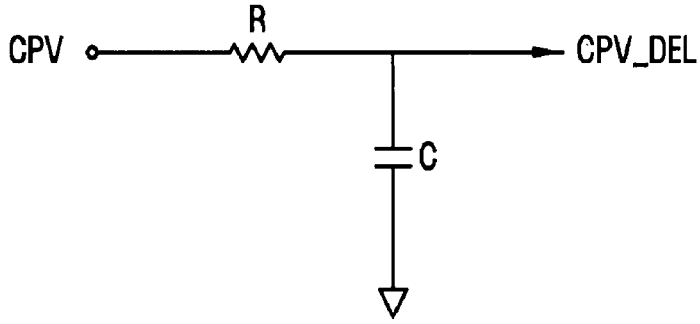
FIG. 3 is a schematic diagram of a signal delay unit of the exemplary LCD signal generating circuit of FIG. 2.

FIG. 2 is a functional block diagram of a first exemplary embodiment of a signal generating circuit 310 of the exemplary LCD of FIG. 1. FIG. 3 is a schematic diagram of a signal delay unit of the exemplary LCD signal generating circuit of FIG. 2.

As illustrated in FIG. 2, the first exemplary signal generating circuit 310 includes a signal delay unit 312, a signal inversion unit 314, a first signal operation unit 316 and a second signal operation unit 318. The signal delay unit 312 is operable to delay a gate clock signal CPV that comprises the combination of a gate-on signal and a gate-off signal for a selected amount of time and to then output the delayed signal as a gate clock delay signal CPV_DEL. In the particular exemplary embodiment illustrated, the signal delay unit 312 may be configured as an RC delay network that includes a resistor R and a capacitor C, as illustrated in FIG. 3. Thus, any noise that may be included on the gate clock signal CPV is removed according to the values of the resistance and capacitance of the network, and accordingly, the gate clock signal CPV is delayed by the selected amount of time.

The signal inversion unit 314 is operable to invert the gate clock delay signal CPV_DEL and to output the inverted signal as an inverted gate clock delay signal CPV_DEL_INV. The inversion unit 314 may comprise, for example, a known type of PMOS transistor and an NMOS transistor inverter.

The first signal operation unit 316 of the exemplary circuit 310 performs a logical AND operation on the gate clock signal CPV and the inverted gate clock delay signal CPV_DEL_INV and generates an internal output enable signal OE_INT. The first signal operation unit 316 may comprise, for example, an AND gate.

The second signal operation unit 318 performs a logical OR operation on an internal output enable signal OE_INT and an output enable signal OE and generates a gate control output enable signal OE_CON. The second signal operation unit 318 may comprise, for example, an OR gate.

Figure 4:
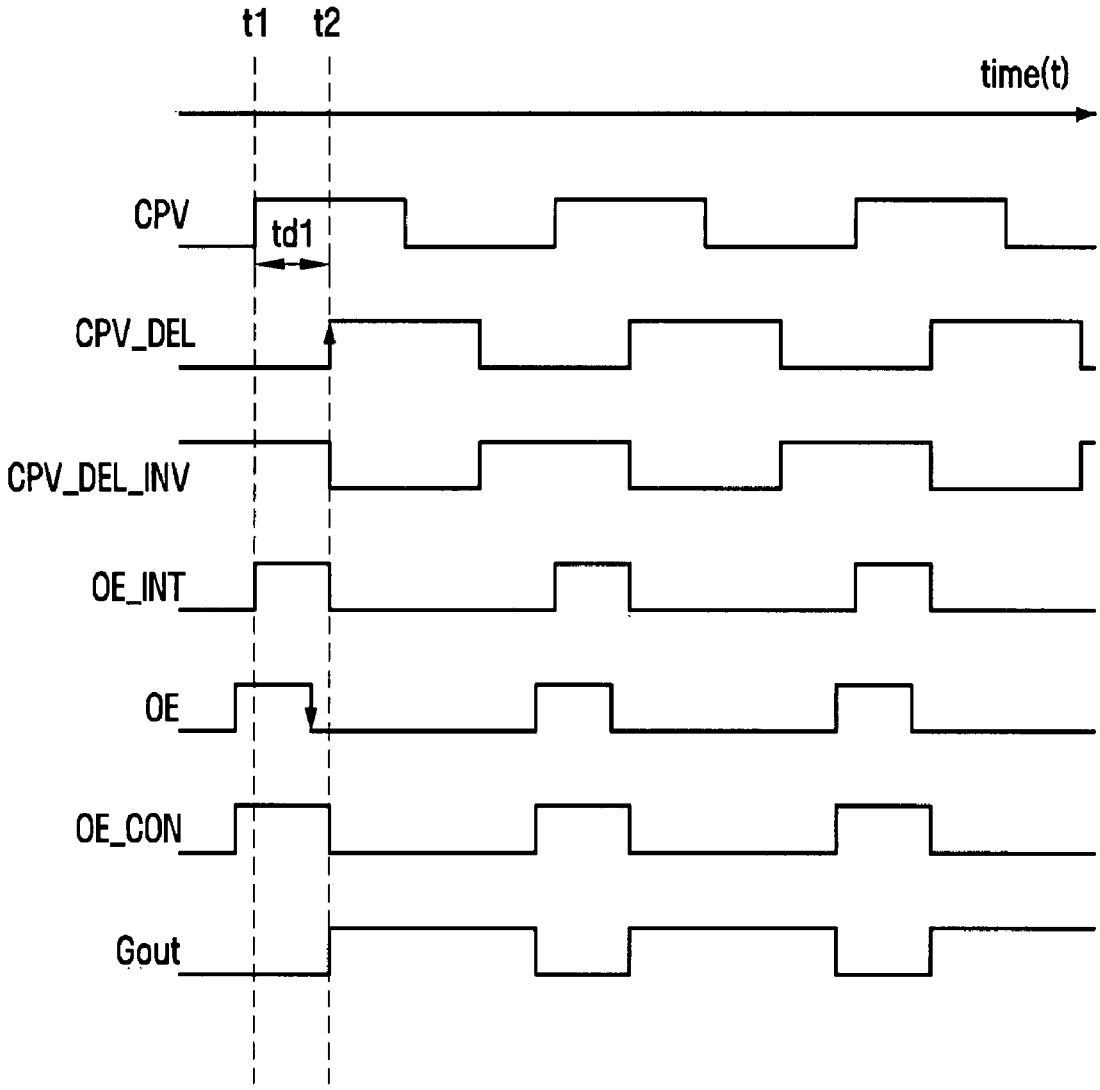
FIG. 4 is a timing diagram illustrating output enable signal states when the gate clock delay signal according to the first exemplary embodiment of the present invention is delayed a relatively long period of time.

FIG. 4 is a timing diagram illustrating output enable signal states when the gate clock delay signal according to the first exemplary embodiment of the present invention is delayed for a relatively long period of time.

As illustrated in FIG. 4, at a point in time t1, the gate clock signal CPV is in a logic "high" state, the gate clock delay signal CPV_DEL is in a logic "low" state, the inverted gate clock delay signal CPV_DEL_INV is in a logic "high" state, the internal output enable signal OE_INT is in a logic "high" state, the output enable signal OE is in a logic "high" state, and the gate control output enable signal OE_CON is in a logic "high" state, resulting in an output signal Gout of the gate driver 300 being in a "low" state. However, it should be understood that the output signal Gout of the gate driver 300 is not actually output at this time.

At a point in time t2, the gate clock signal CPV is in a logic "high" state, the gate clock delay signal CPV_DEL is in a logic "high" state, the inverted gate clock delay signal CPV_DEL_INV is in a logic "high" state, the internal output enable signal OE_INT is in a logic "high" state, the output enable signal OE is in a logic "low" state, and the gate control output enable signal OE_CON is in a logic "high" state, resulting in the output signal Gout of the gate driver 300 being in a logic "high" state. At this time, the rising edge of the gate clock delay signal CPV_DEL overlaps the falling edge of the gate control output enable signal OE_CON. At this point in time, the gate-on signal Von is output from the gate driver 300 as the output signal Gout.

If the falling edge of the output enable signal OE precedes the rising edge of the gate clock delay signal CPV_DEL due to an overly prolonged delay td1 of the gate clock signal CPV, the timings of the gate clock signal CPV and the output enable signal OE do not coincide with each other, which can result in an abnormal output. Thus, in order to make the gate driver 300 output a normal output irrespective of any delay time of the gate clock signal CPV, it is necessary to adjust the output enable signal OE such that the falling edge of the output enable signal OE overlaps the rising edge of the gate clock delay signal CPV_DEL.

Therefore, in the first embodiment of the present invention of FIG. 2, an AND operation is performed on the gate clock signal CPV and the inverted gate clock delay signal CPV_DEL_INV to generate the internal output enable signal OE_INT, and an OR operation is then performed on the internal output enable signal OE_INT and the output enable signal OE to operate the gate driver 300 under any condition.

The operation of the first exemplary signal generating circuit 310 is described below with reference to FIG. 5, which is a flow chart illustrating the operation of the first exemplary LCD signal generating circuit of FIG. 2.

Figure 5:
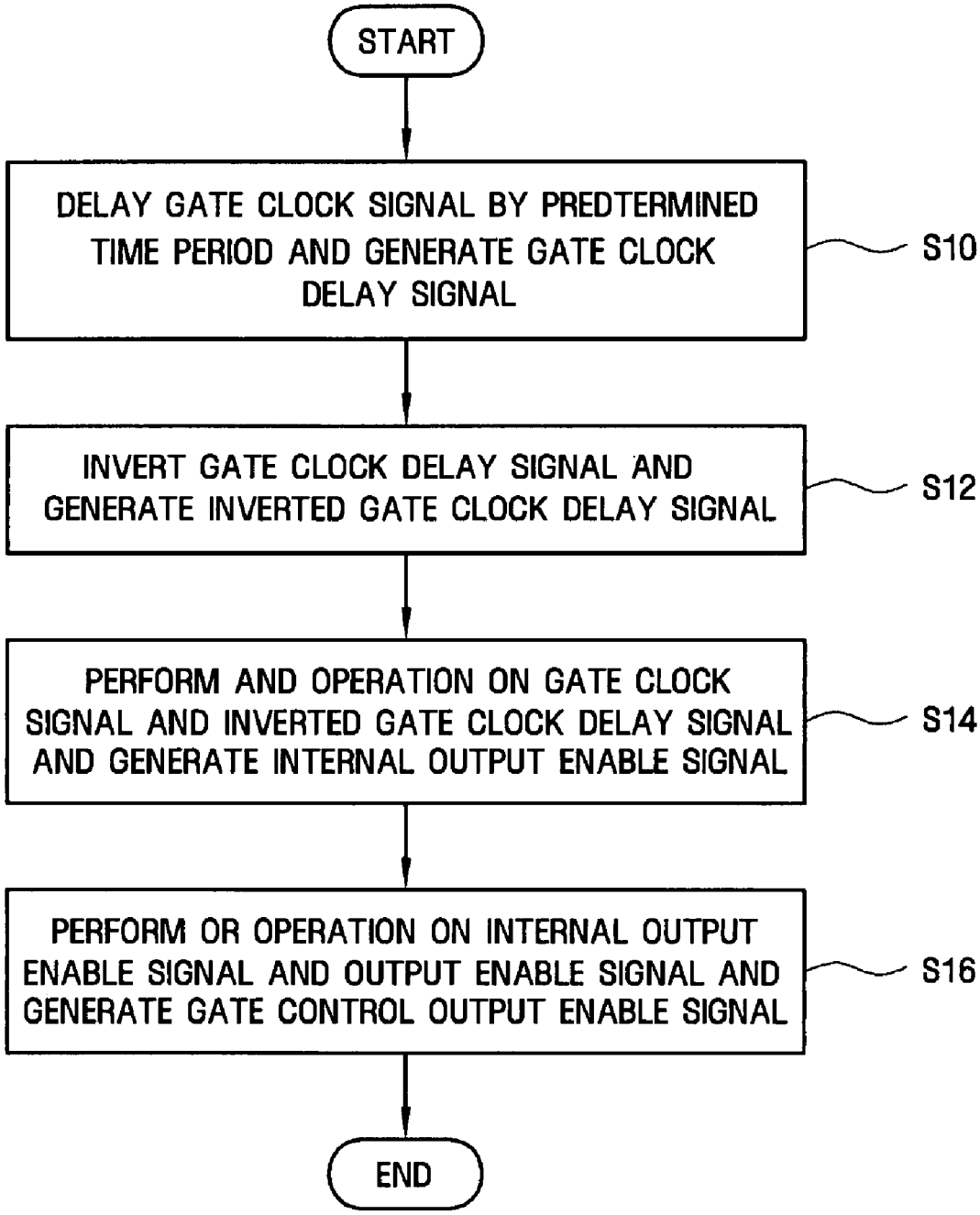
FIG. 5 is a flow chart illustrating the operation of the first exemplary LCD signal generating circuit of FIG. 2.

Referring to FIG. 5, at S10, the gate clock signal CPV is delayed for a selected amount of time by the signal delay unit 312, and the gate clock delay signal CPV_DEL is thereby generated, as illustrated in FIG. 4.

In S12 of FIG. 5, the gate clock delay signal CPV_DEL output from the signal delay unit 312 is input to the signal inversion unit 314 and the inversion unit 314 generates an inverted gate clock delay signal CPV_DEL_INV, as shown in FIG. 4.

In S14, the inverted gate clock delay signal CPV_DEL_INV output from the inversion unit 314 is input to the first signal operation unit 316, and the first signal operation unit 316 performs an AND operation on the gate clock signal CPV and the inverted gate clock delay signal CPV_DEL_INV and thereby generates an internal output enable signal OE_INT. In the exemplary embodiment illustrated in FIG. 4, the rising edge of the gate clock delay signal CPV_DEL overlaps the falling edge of the internal output enable signal OE_INT.

In S16, the internal output enable signal OE_INT that is output from the first signal operation unit 316 is input to the second signal operation unit 318, which performs an OR operation on the internal output enable signal OE_INT and the output enable signal OE to thereby generate the gate control output enable signal OE_CON, as illustrated in FIG. 4. As illustrated therein, the rising edge of the gate clock delay signal CPV_DEL overlaps the falling edge of the gate control output enable signal OE_CON.

Figure 6:
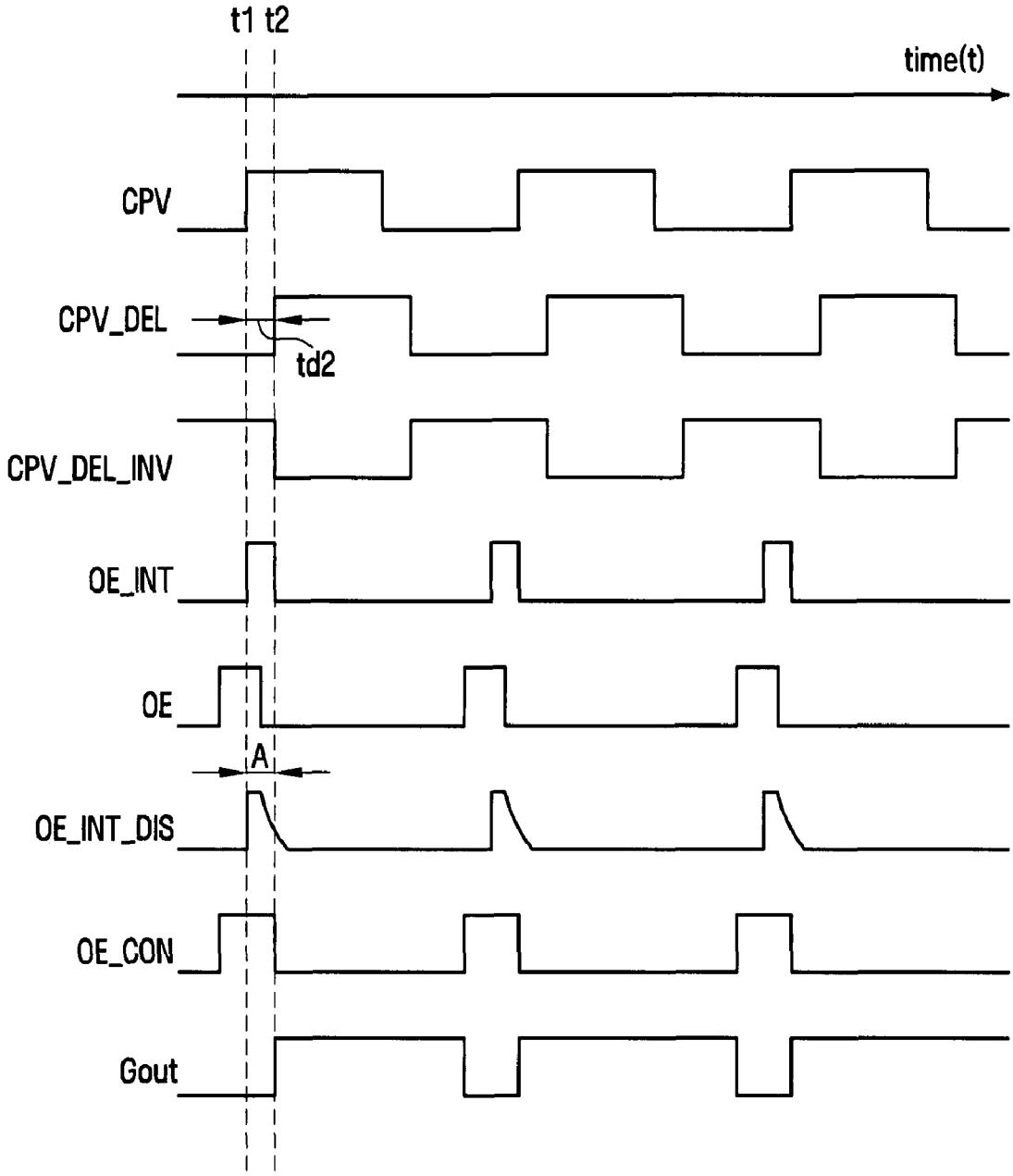
FIG. 6 is a timing diagram illustrating output enable signal states when the gate clock delay signal according to the first exemplary embodiment of the present invention is delayed a relatively short period of time.

FIG. 6 is a timing diagram illustrating output enable signal states when a gate clock delay signal according to the first embodiment of the present invention is delayed a relatively short amount of time.

As illustrated in FIG. 6, from a point in time t1 to a point in time t2, in the case where the delay td2 of the gate clock signal CPV is small, and thus, the polling edge of the output enable signal OE precedes the rising edge of the gate clock delay signal CPV_DEV, the width A of the internal output enable signal OE_INT is reduced, so that a more severe distortion in the internal output enable signal OE_INT is generated as the internal output enable signal OE_INT is applied closer to the end of the line due to resistance and capacitance components, resulting in a distorted internal output enable signal OE_INT_DIS. Thus, a high level of the internal output enable distortion signal OE_INT_DIS may be detected at the rising edge of the next gate clock signal CPV, and accordingly, the gate driver 300 may not function properly. In order to prevent this, an internal output enable signal OE_INT is generated, and an OR operation is performed on the internal output enable signal OE_INT and the output enable signal OE, thereby enabling the gate driver 300 to function properly under any condition.

Figure 7:
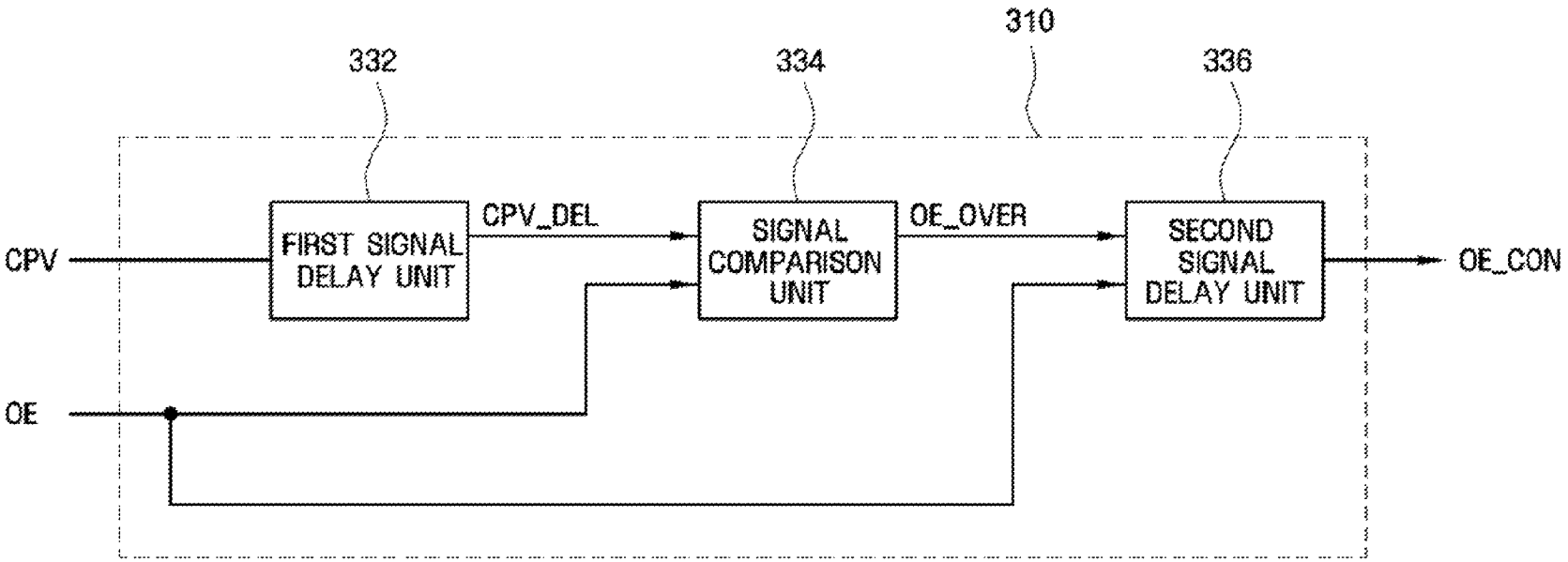
FIG. 7 is a functional block diagram of a second exemplary embodiment of a signal generating circuit of the exemplary LCD; and, FIG. 8 is a flow chart illustrating the operation of the second exemplary LCD signal generating circuit of FIG. 7.

FIG. 7 is a functional block diagram of a second exemplary embodiment of an LCD signal generating circuit 310 in accordance with the present invention. The exemplary signal generating circuit 310 of FIG. 7 includes a first signal delay unit 332, a signal comparison unit 334, and a second signal delay unit 336.

The first signal delay unit 332 delays the gate clock signal CPV for a selected amount of time and outputs the delayed signal as a gate clock delay signal CPV_DEL. In this embodiment, the first signal delay unit 332 may be configured as an RC delay network that includes a resistor R and a capacitor C that, depending on the values of resistance and capacitance, functions to filter, or remove, any noise included in the gate clock signal CPV. As a result, the gate clock signal CPV is also delayed by the selected time period. In one preferred exemplary embodiment, the time delay of the gate clock signal CPV ranges from about 400 to about 600 ns.

The signal comparison unit 334 compares the falling edge of the output enable signal OE with the rising edge of the gate clock delay signal CPV_DEL to determine whether or not they overlap each other. If the falling edge of the output enable signal OE overlaps the rising edge of the gate clock delay signal CPV_DEL, the signal comparison unit 334 outputs an overlap signal OE_OVER having a logical "low" level. However, if the falling edge of the output enable signal OE does not overlap the rising edge of the gate clock delay signal CPV_DEL, that is, if the falling edge of the output enable signal OE precedes the rising edge of the gate clock delay signal CPV_DEL, then the signal comparison unit 334 outputs an overlap signal OE_OVER having a logical "high" level.

The second signal delay unit 336 delays the output enable signal OE according to the overlap signal OE_OVER by a selected amount of time and then outputs the delayed signal as a gate control output enable signal OE_CON. That is, where the overlap signal OE_OVER is a logic low level signal, the output enable signal OE is output as the gate control output enable signal OE_CON. On the other hand, where the overlap signal OE_OVER is a logical high level signal, the output enable signal OE is delayed by an amount time corresponding to the difference in time between the falling edge of the output enable signal OE and the rising edge of the gate clock delay signal CPV_DEL, and the delayed signal of the output enable signal OE is then output as the gate control output enable signal OE_CON.

Figure 8:
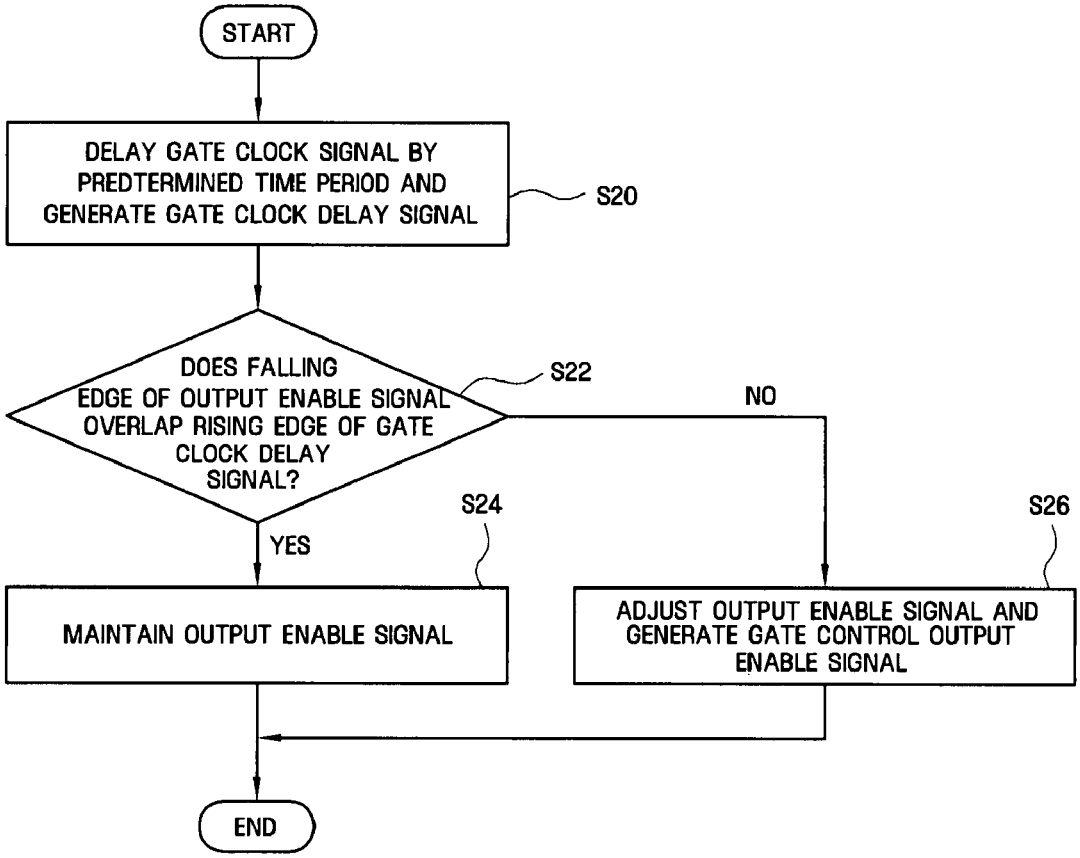

FIG. 8 is a flow chart illustrating the operation of the second exemplary LCD signal generating circuit of FIG. 7. With reference to FIG. 8, in S20, the gate clock signal CPV is delayed for a selected amount of time using the first signal delay unit 332, thereby generating the gate clock delay signal CPV_DEL.

In S22, the gate clock delay signal CPV_DEL and the output enable signal OE are input to the signal comparison unit 334, and the signal comparison unit 334 compares the falling edge of the output enable signal OE with the rising edge of the gate clock delay signal CPV_DEL to determine whether or not the respective edges of the two signals overlap each other, and based on the result of the comparison, generates an overlap signal OE_OVER having either a logic high or logic low level, as described above.

If the falling edge of the output enable signal OE overlaps the rising edge of the gate clock delay signal CPV_DEL, the signal comparison unit 334 outputs an overlap signal OE_OVER having a logic low level. The second signal delay unit 336 then receives the overlap signal OE_OVER and the output enable signal OE as inputs, and in S24, outputs the output enable signal OE as the gate control output enable signal OE_CON.

In S26, if the falling edge of the output enable signal OE does not overlap the rising edge of the gate clock delay signal CPV_DEL, then the signal comparison unit 334 outputs an overlap signal OE_OVER having a logic high level, and the second signal delay unit 336 then delays the output enable signal OE a amount of time corresponding to the difference in time between the falling edge of the output enable signal OE and the rising edge of the gate clock delay signal CPV_DEL, and then outputs the delayed signal of the output enable signal OE as the gate control output enable signal OE_CON.

As will be appreciated by those of skill in the art, in the exemplary LCD signal generating circuits described above, the gate driver of the LCD is made to operate properly without malfunctions by adjusting an output enable signal such that a falling edge of the output enable signal overlaps a rising edge of a gate clock delay signal.

Moreover, as those of skill in this art will also appreciate, many modifications, substitutions and variations can be made in and to LCD signal generating circuits of this invention without departing from its spirit and scope. In light of this, the scope of the present invention should not be limited to that of the particular embodiments illustrated and described herein, as they are only exemplary in nature, but instead, should be fully commensurate with that of the claims appended hereafter and their functional equivalents.

What is claimed is:

1. A signal generating circuit comprising:

a signal delay unit operable to delay a gate clock signal which is input to the signal generating circuit for a selected amount of time and to output a delayed signal as the gate clock delay signal;

an inversion unit operable to invert the gate clock delay signal and to output the inverted signal as an inverted gate clock delay signal;

a first signal operation unit operable to perform a logical AND operation on the gate clock signal and the inverted gate clock delay signal, thereby generating an internal output enable signal; and a second signal operation unit operable to perform a logical OR operation on the internal output enable signal and an output enable signal which is input to the signal generating circuit, thereby generating a gate control output enable signal.

2. The signal generating circuit of claim 1, wherein the falling edge of the internal output enable signal overlaps the rising edge of the gate clock delay signal.

3. The signal generating circuit of claim 1, wherein the falling edge of the gate control output enable signal overlaps the rising edge of the gate clock delay signal.

4. The signal generating circuit of claim 1, wherein the gate clock delay signal and the gate control output enable signal are configured to control the output time of a gate-on voltage Von, and to define the width of the gate-on voltage Von.

5. A signal generating circuit comprising:

a first signal delay unit operable to delay a gate clock signal which is input to the signal generating circuit for a selected amount of time and to output the signal as a gate clock delay signal;

a signal comparison unit operable to compare the falling edge of an output enable signal which is input to the signal generating circuit and the rising edge of the gate clock delay signal, to determine whether or not the respective edges of the two signals overlap each other, and to output an overlap signal having a logic level based on the result of the comparison; and a second signal delay unit operable to delay the output enable signal for a selected amount of time corresponding to the level of the overlap signal and to output the delayed signal as the gate control output enable signal.

6. The signal generating circuit of claim 5, wherein the logic level of the overlap signal is either a logical high or a logical low signal, depending on the result of the comparison.

7. The signal generating circuit of claim 5, wherein the second signal delay unit is operable to delay the output enable signal by an amount of time corresponding to the difference in time between the falling edge of the output enable signal and the rising edge of the gate clock delay signal.

8. The signal generating circuit of claim 5, wherein the falling edge of the gate control output enable signal overlaps the rising edge of the gate clock delay signal.

9. The signal generating circuit of claim 5, wherein the gate clock delay signal and the gate control output enable signal are configured to control the output time of a gate-on voltage Von, and define the width of the gate-on voltage Von.

10. A liquid crystal display (LCD) comprising:

a liquid crystal display panel including a plurality of unit pixels arranged in substantially a matrix form thereon, a plurality of gate lines and a plurality of data lines;

a timing controller generating a plurality of control signals for controlling the liquid crystal display panel, the control signals including a gate clock signal, and an output enable signal which are configured to control the output time of a gate-on voltage Von, and define the width of the gate-on voltage Von;

a driving voltage generator receiving the plurality of control signals and generating a plurality of driving voltages;

a gate driver receiving the plurality of driving voltages and applying the received driving voltages to the gate lines; and a data driver applying data voltages to the data lines, wherein the gate driver comprises a signal generating circuit, and the signal generating circuit receives the gate clock signal and the output enable signal and is operable to adjust the output enable signal such that a falling edge of the output enable signal overlaps a rising edge of the gate clock delay signal;

a signal delay unit operable to delay the gate clock signal for a selected amount of time and to output the delayed signal as the gate clock delay signal;

an inversion unit operable to invert the gate clock delay signal and to output the inverted signal as an inverted gate clock delay signal;

a first signal operation unit operable to perform a logical AND operation on the gate clock signal and the inverted gate clock delay signal and thereby generate an internal output enable signal; and a second signal operation unit to perform a logical OR operation on the internal output enable signal and the output enable signal and thereby generate a gate control output enable signal.

11. The LCD of claim 9, wherein the falling edge of the internal output enable signal overlaps the rising edge of the gate clock delay signal.

12. The LCD of claim 9, wherein the falling edge of the gate control output enable signal overlaps the rising edge of the gate clock delay signal.

13. A liquid crystal display (LCD) comprising:

a liquid crystal display panel including a plurality of unit pixels arranged in substantially a matrix form thereon, a plurality of gate lines and a plurality of data lines;

a timing controller generating a plurality of control signals for controlling the liquid crystal display panel, the control signals including a gate clock signal, and an output enable signal which are configured to control the output time of a gate-on voltage Von, and to define the width of the gate-on voltage Von;

a driving voltage generator receiving the plurality of control signals and generating a plurality of driving voltages;

a gate driver receiving the plurality of driving voltages and applying the received driving voltages to the gate lines; and a data driver applying data voltages to the data lines, wherein the gate driver comprises a signal generating circuit, and the signal generating circuit receives the gate clock signal and the output enable signal and is operable to adjust the output enable signal such that a falling edge of the output enable signal overlaps a rising edge of the gate clock delay signal;

a first signal delay unit operable to delay the gate clock signal a selected amount of time and to output the delayed signal as a gate clock delay signal;

a signal comparison unit operable to compare the falling edge of the output enable signal with the rising edge of the gate clock delay signal, to determine whether or not the respective edges of the two signals overlap each other, and to output an overlap signal having a logic level based on the result of the comparison; and a second signal delay unit operable to delay the output enable signal an amount of time corresponding to the logic level of the overlap signal and to output the delayed signal as the gate control output enable signal.

14. The LCD of claim 13, wherein the logic level of the overlap signal is either a logical high or a logical low signal, depending on the result of the comparison.

15. The LCD of claim 13, wherein the second signal delay unit delays the output enable signal by an amount of time that corresponds to the difference in time between the falling edge of the output enable signal and the rising edge of the gate clock delay signal.

16. The LCD of claim 13, wherein the falling edge of the gate control output enable signal overlaps the rising edge of the gate clock delay signal.

* * * * *